United States Patent [19]

Schoenholz et al.

[11] 4,193,886

[45] * Mar. 18, 1980

[54] NOVEL LOW TEMPERATURE CLEANER

[75] Inventors: Daniel Schoenholz, Basking Ridge; Arthur W. Petersen, Chatham Township, Morris County; Marcus A. Northup, Jr., Morristown, all of N.J.

[73] Assignee: Church & Dwight Co., Inc., Piscataway, N.J.

[ * ] Notice: The portion of the term of this patent subsequent to May 6, 1992, has been disclaimed.

[21] Appl. No.: 679,333

[22] Filed: Apr. 22, 1976

[51] Int. Cl.[2] ..... C11D 7/26; C11D 7/12

[52] U.S. Cl. ..... 252/90; 134/2; 134/40; 252/156; 252/158; 252/174.14

[58] Field of Search ..... 252/156, 158, 90, 174.14; 134/2, 40

[56] References Cited

U.S. PATENT DOCUMENTS

| | | | |
|---|---|---|---|
| 3,031,408 | 4/1962 | Perlman et al. | 252/154 |
| 3,330,767 | 7/1967 | Herrick et al. | 252/135 X |
| 3,658,711 | 4/1972 | Mukai et al. | 252/90 |
| 3,672,993 | 6/1972 | Mitchell et al. | 134/3 |
| 3,779,933 | 12/1973 | Eisen | 252/158 X |
| 3,808,051 | 4/1974 | Schoenholz et al. | 134/2 |
| 3,881,948 | 5/1975 | Schoenholz et al. | 134/2 |

*Primary Examiner*—Harris A. Pitlick
*Attorney, Agent, or Firm*—Hammond & Littell, Weissenberger and Muserlian

[57] ABSTRACT

A weakly alkaline cleaning composition for the removal of soils containing free or combined organic acids comprising (A) at least one polyhydric alcohol or a lower aliphatic ether or ester thereof having at least 2 free hydroxy groups, (B) 1.0 to 500% by weight of at least one alkali metal bicarbonate based on the weight of the polyhydric alcohol and (C) 5.0 to 1000% by weight of at least one alkali metal salt of a weak organic acid based on the weight of the polyhydric alcohol and a method of removing soils containing free or combined organic acids from a surface.

10 Claims, No Drawings

NOVEL LOW TEMPERATURE CLEANER

STATE OF THE ART

The removal of soils containing free or combined organic acids from hard surfaces such as metal or ceramics has received much study. This type of soil occurs as a varnish on engine parts or as soil in ovens, baking pans, barbecue racks, etc. The organic acid in the soil is usually in the form of the free acid or as easily saponifiable esters thereof.

Oven interiors soiled by baked-on grease and splattered food stuffs have been cleaned by applying to the soiled interiors solutions containing saponification agents, catalytic metal salts and oxides, as well as ammonia producing compounds, either preceded or followed by heating of the soiled interiors in order to cause a chemical reaction with the soiling agent. For example see U.S. Pat. Nos. 3,549,419; 3,031,408; 3,031,409; 3,079,284; 3,196,046; 3,331,943 or 3,335,092. However, there are certain difficulties associated with the use of the above solutions, such as harsh fumes emanating from the oven which are harmful to the eyes and on contact can produce skin damage. These solutions if accidently spilled during usage are capable of producing corrosion damage to floor, painted surfaces, chrome, aluminum, etc.

It has also been suggested to utilize liquid silicone preparations on clean oven walls to keep food residues from sticking, and/or to make any residues easier to wash out after use as can be seen in U.S. Pat. Nos. 3,303,052; 3,196,027; and 3,183,110. The difficulty herein is that these preparations are only effective if applied to a clean oven before the walls become soiled, and they are not effective for cleaning the walls once they have become soiled.

Ovens having catalytic oven liners intended to be continuously self-cleaning at normal use temperatures below 600° F. are also known as described in U.S. Pat. Nos. 3,460,523 and 3,266,477. Another proposal has been to design ovens for self-cleaning with auxiliary heaters intended to raise the oven temperature to about 900° C. to burn off spilled food stuffs. It has also been proposed to equip such ovens with catalytic after burners to consume smoke generated during cleaning as in U.S. Pat. Nos. 3,428,434; 3,428,435; and 3,423,568. These devices are not without certain difficulties in that they will sometimes emit smoke if major spills are not wiped up before heating to the cleaning temperature range. Furthermore, it is necessary to resort to oven temperatures much higher than normally used in order for the self-cleaning device to become operable.

In our, commonly assigned U.S. patent application Ser. No. 361,140 filed May 17, 1973 now U.S. Pat. No. 3,808,051 we describe a cleaning composition for the removal of organic acid containing soil comprising (A) at least 1% by weight of a substance selected from the groups consisting of (1) at least one alkali metal salt of a weak organic acid, said salt melting at elevated temperatures, preferably below about 550° F. and said weak organic acid constituent part being volatile and/or decomposing at said elevated temperatures on contact with organic acid containing soils or (2) mixtures of salts thereof, the mixtures having melting points lower than the cleaning temperature, preferably less than 550° F.; and (B) up to 99% by weight of a carrier. The novel method of cleaning organic acid containing soils described therein comprises applying the said salt or salts of weak organic acid to said soil, heating the salt(s) and soil above the melting point of the said salt(s) and then removing the residue.

The mode of action in our application Ser. No. 361,140 is believed due to reaction of the alkali metal ions with the organic acids in the soil or their easily saponified esters to form the alkali metal salts of the organic acid which are then easily removed while an approximately proportionate amount of the weak acid is volatilized and/or decomposed. The best results are obtained at higher temperatures of about 450°-550° C.

Our commonly assigned application Ser. No. 381,053 filed July 20, 1973, now U.S. Pat. No. 3,881,948 describes weakly alkaline cleaning compositions comprising at least one polyhydric alcohol or a lower aliphatic carboxylic acid ester or ether thereof having at least 2 free hydroxyl groups and a small amount, i.e., up to 2% by weight, of an alkaline acting catalyst selected from the group consisting of alkali metal and alkaline earth bases and salts which are most effective at temperatures of 250° F. to 350° F. for removing the soil residue from the said surface.

It is believed that the polyhydric alcohols and their aliphatic carboxylic esters or ethers having at least two free hydroxyl groups when heated above 250° F. with the soil containing the organic acid undergo an alcoholysis reaction resulting in the formation of water-soluble or dispersible compounds which are easily washed away. The presence of the alkaline reacting compound in small amounts is believed to catalyze the alcoholysis reaction. However, hot areas as high as 550° F. or higher such as those adjacent to the heating elements were not cleaned as thoroughly as the other portions since the alcohol tended to evaporate and/or deteriorate before alcoholysis was completely effected.

OBJECTS OF THE INVENTION

It is an object of the invention to provide novel compositions for removing organic acid containing soil wherein the active ingredients are (A) a polyhydric alcohol with at least 2 free hydroxy groups, (B) a small amount of an alkali metal bicarbonate capable of accelerating alcoholysis reactions and (C) at least one alkali metal salt of a weak organic acid.

It is another object to provide a novel method of removing organic acid containing soil from a surface.

It is a further object of the invention to provide a novel method of removing food soil from ovens at normal operating temperatures without corrosive materials and with minimal noxious fumes.

These and other objects and advantages of the invention will become obvious from the following detailed description.

THE INVENTION

The novel weakly alkaline cleaning compositions of the invention are comprised of (A) at least one polyhydric alcohol or a lower aliphatic ether or ester thereof having at least 2 free hydroxy groups, (B) 1.0 to 500% by weight of at least one alkali metal bicarbonate based on the weight of the polyhydric alcohol and (C) 5.0 to 1000% by weight of at least one alkali metal salt of a weak organic acid based on the weight of the polyhydric alcohol. Weakly alkaline means a pH of less than 10, preferably between 8-9.

The polyhydric alcohols and their aliphatic carboxylic esters or ethers having at least 2 free hydroxyl groups should be sufficiently non-volatile to be retained on the surface to be cleaned at the operating temperatures. Since some polyhydric alcohols are co-distilled or steam distilled when water is present in the composition, the compositions should contain as little water as possible, preferably being anhydrous. If water is present in the composition, and the selected polyhydric alcohol is also distillable then more of the alcohol should be used to ensure thorough cleaning. When the compositions are to be used for oven cleaning, it is preferred to use compositions containing little or no water and to use a less volatile polyhydric compound to avoid excessive loss by distillation.

Such less volatile polyhydric alcohol compounds should preferably boil above about 300° F., be water soluble for ease of washing out any quantity remaining after heating, and should preferably melt below about 500° F. to facilitate good contact with the soiled surface. We have found that polyhydric compounds having a numerical ratio of carbon atoms to hydroxyl groups as high as 15 to 1 may be used, but that those having a ratio of 4 to 1 or less are preferable. Sorbitol is the most preferred.

Examples of suitable polyhydric alcohol compounds having at least 2 free hydroxy groups are ethylene glycol, diethylene glycol, triethylene glycol, various commercial mixtures of higher polyethylene glycols such as Carbowax 400 sold by the Union Carbide Corporation, glycerol, diglycerol, triglycerol and higher mixed polyglycerols, pentaerythritol, inositol, trimethylol ethane, trimethylol propane, sorbitol, mannitol, aliphatic diols such as 1,4-butanediol, aliphatic triols such as 1,2,6-trihydroxyhexane and lower aliphatic carboxylic acid esters having at least 2 free hydroxy groups such as monoacetin. The preferred compounds are mannitol and sorbitol since they are non-volatile and do not fume even when used in aqueous solutions of the salts.

The aliphatic carboxylic acids used to form the esters have 1 to 7 carbon atoms and examples of said acids are acetic acid, propionic acid, butyric acids, acrylic acid, etc. The ethers may be alkyl ethers of 1 to 7 alkyl carbon atoms or polyglycols or polyglycerols.

The alkali metal bicarbonates act as an alkaline acting catalyst capable of accelerating the alcoholysis reaction and have the further advantage of being less alkaline than strong bases such as alkali metal carbonate. This means the compositions may contain larger amounts of alkali metal bicarbonates while keeping the compositions weakly alkaline, i.e., pH of less than 10. Sodium bicarbonate and potassium bicarbonate are the most common ones and potassium is preferred since the potassium compounds formed during the cleaning reaction are more easily removed.

The alkali metal salts used in the method may be salts of weak organic acids which melt within the desired range or mixtures of alkali metal salts which melt within the desired range whether or not the individual salts will melt therein. Examples of suitable alkali metal salts of weak organic acids are salts of aliphatic and alicyclic carboxylic acids of one to 10 carbon atoms, preferably of one to seven carbon atoms. The alkali metal may be any of the known alkali metals but preferably sodium, potassium and/or lithium and eutectic mixtures of the salts thereof.

Examples of specific salts are alkali metal formates such as sodium formate; alkali metal glycolates such as sodium glycolate; alkali metal glycinates such as sodium glycinate; sodium adipate, sodium tartrate, potassium tartrate, Rochelle salt (sodium potassium tartrate) and alkali metal acetates such as sodium acetate, potassium acetate and lithium acetate and binary and ternary mixtures thereof.

In a preferred embodiment, the salt mixtures are binary or ternary mixtures of the alkali metal salts of weak acids such as alkali metal acetates, preferably lithium acetate, sodium acetate and potassium acetate and these mixtures may optionally contain alkali metal salts of weak acids which will lower the melting point of the mixtures even further, such as alkali metal acetate mixtures containing an alkali metal glycolate, an alkali metal gluconate, an alkali metal glycinate, or an alkali metal formate, preferably sodium glycolate, sodium glycinate, or sodium formate.

In a preferred embodiment, sodium glycolate or sodium glycinate are added to mixtures of alkali metal acetates and each has the effect of lowering the melting point 5 to 10 percent and of slightly speeding up cleaning.

The compositions of the invention have the advantage that they are especially effective for cleaning the major portions of soiled oven surfaces without need to heat the ovens above the moderate temperatures used in cooking, for example 300° to 350° F. At the same time, they provide a reserve of high temperature action to clean hard burned soils that would not otherwise be removed from the overheated spots that occur on the bottom plate directly over the burner in gas ovens or adjacent to the heating elements in electrical ovens. Moreover, they are safe to handle and will not cause noxious fumes.

The physical form of the compositions may vary considerably depending upon whether the composition is to be utilized as a paste, liquid, or aerosol. Thickened solutions or suspensions of the compositions which can be applied by brush or solutions packaged in aerosol containers and applied by spraying are preferred for application to overhead or vertical surfaces.

The concentration of the said polyhydric alcohol (A) in the paste, liquid or aerosol preparations may be as low as 1% by weight based upon the total weight of the preparation not including propellant, if present, but is preferably between 1 and 10%. There is also present 1.0 to 500% by weight of at least one alkali metal bicarbonate (B) based on the weight of the polyhydric alcohol and, (C) 5.0 to 1000% by weight of at least one alkali metal salt of a weak organic acid based on the weight of the polyhydric alcohol. There may be up to 98.4% by weight based upon the total weight of the preparation, of a carrier, or in the case of an aerosol preparation, carrier plus propellant.

Any thickening agent compatible with the polyhydric alcohol composition may be used. Some useful organic agents are starch, sodium carboxymethylcellulose, hydroxyethyl cellulose, methocel, and water-soluble polymers such as carboxy vinyl polymer (Carbopols from B. F. Goodrich Chemical Company) and most preferred are Xanthan gums. Inorganic colloidal material such as Veegum (magnesium aluminum silicates manufactured by R. T. Vanderbilt) are also effective.

It may also be preferable to have present as a component of the solutions a minor amount of surface active agent which will cause the solution to spread evenly over the soiled surface, or to form a foam. The surface active agents can be any of those commonly known and used as such. An extensive list of such agents appears in the publication McCutcheon's Detergents & Emulsifiers, 1974 Annual. The agents can be anionic, cationic, nonionic, or amphoteric and should be compatible with the other ingredients and impart the desired surface active properties.

Examples of anionic surfactants include (a) carboxylic acids such as soaps of straight chain naturally occuring fatty acids, chain-substituted derivatives of fatty acids, branched-chain and odd-carbon fatty acids, acids from paraffin oxidation, and carboxylic acids with intermediate linkages; (b) sulfuric esters such as sodium lauryl sulfate, tallow alcohol sulfates and coconut alcohol sulfates.

Examples of cationic surfactants include (a) non-quaternary nitrogen bases such as amines without intermediate linkages, and (b) quaternary nitrogen bases of the formula $$\left[ R-\overset{\overset{a}{|}}{\underset{\underset{c}{|}}{N}}-b \right]^{+} X^{-}$$

wherein R is straight-chain alkyl of 12 to 19 carbon atoms, wherein a,b, and c are methyl, ethyl or benzyl (usually not more than one benzyl group being present), and wherein X is halide such as chloride, bromide or iodide, methylsulfate or ethylsulfate and quaternary ammonium salts such as Hyamine 10X (diisobutylcresoxy ethoxyethyl dimethylbenzyl ammonium chloride monohydrate).

Examples of nonionic surfactants include polyethyleneoxy ethers of alkylphenols, alkanols, mercaptans esters as well as polyethyleneoxy compounds with amine links.

The preferred cleaning compositions are those where the alkali metal salt of a weak organic acid is a binary or ternary mixture of alkali metal salts of acetic acid, preferably lithium, potassium and sodium acetate mixtures. The mixtures with the lowest melting point are desired as this means lower cleaning temperatures are obtained.

It is also preferable to have suspended in the compositions of the invention a finely divided substance such as ground calcium carbonate to aid in keeping the cleaner spread evenly over the surface as the temperatures rises and the active cleaning agents become molten. Many of the active cleaning materials have a tendency when molten and rendered fluid by high temperatures to either drain off the oven walls or to contract into puddles leaving portions of a solid surface uncovered by the cleaning agent. It has been found that certain of the organic thickening agents which may be incorporated to control flow during initial application of the composition and which are effective for the purpose at room temperature tend to lose their thickening ability at elevated temperatures so that a heat stable auxiliary thickening and flow control agent is desirable. The amount of such finely divided material may range from 1 to 60% by weight of the aqueous cleaner composition but is preferably between 2% and 10% for use in the form of aerosols. For paste compositions, the finely divided material may range from about 1.0 to 8.0 times the weight of active cleaning components but is preferably between one and four times the weight of the active components. Examples of finely divided inorganic materials include precipitated calcium carbonate, silica, feldspar, clay and talc.

It has been found that the use of alkaline finely divided materials such as alkaline earth metal carbonates, has the added advantage that they will react and/or absorb the volatile acid to avoid any minor amounts of acid in the atmosphere. Particularly preferred is calcite.

A preferred composition is an aerosol composition for oven cleaning comprising in its aqueous concentrate portion 3 to 14% by weight of a cleaning composition consisting of 2 to 5 parts by weight of sorbitol, 0.1 to 4 parts by weight of an alkali metal bicarbonate, and 1 to 5 parts by weight of an eutectic mixture of sodium acetate, lithium acetate and potassium acetate, an aqueous carrier, a thickening agent, a finely divided material, and a wetting agent. To the aqueous concentrate portion is added an aerosol propellant under pressure.

The ratio of the components of the compositions may also be defined by their content in an aqueous concentrate containing 1.0 to 10% by weight of polyhydric alcohols or lower aliphatic ethers or esters thereof having at least 2 free hydroxy groups, 0.1 to 5.0% by weight of an alkali metal bicarbonate and 0.5 to 10% by weight of alkali metal salts of weak organic acids particularly the binary and ternary eutectic mixtures thereof, all percentages by weight being based on the weight of the concentrate. The concentrate may be used as is or diluted before use.

In the following examples there are described several preferred embodiments to illustrate the invention. However, it should be understood that the invention is not intended to be limited to the specific embodiments.

EXAMPLE 1

Twelve inch by eighteen inch porcelain enameled steel panels were carefully cleaned, warmed to about 200° F., and lightly brushed over with melted lard taking care to deposit a thin, uniform coating. The panels were placed in an oven and heated for 60 minutes during the last 40 of which the temperature was maintained at 475° F. On cooling, the panels were seen to be coated with a hard, medium brown, varnish-like layer of baked lard which was generally uniform in appearance, having only minor thick, dark colored streaks caused by flow during heating and only a few scattered small thin spots where the molten lard had pulled away from chance particles of foreign matter on the porcelain surface.

The prepared panels were large enough that strips of several different cleaning compositions could be tested at the same time on a single panel under a single set of conditions thus eliminating variations in results that might otherwise have been caused by minor variations in coating characteristics from one panel to another. Baked lard coatings, prepared in the same manner, have been found by actual tests of several dozen household ovens to closely simulate the behavior of commonly occurring oven soils.

An aqueous carrier mixture suitable for holding the several cleaning agents to be tested in either aerosol or brushable form was prepared and it had the following composition in percent by weight:

| | |
|---|---|
| Deionized water | 88.76% |
| Xanthan gum | 0.41 |
| Dowfax 2A-1 solution (sodium dodecyl ether sulfonate) | 0.09 |
| Sodium nitrate | 0.49 |
| Morpholine | 0.49 |
| Dowicide A, (sodium salt of | 0.03 |

-continued

| | |
|---|---|
| o-phenylphenol-$4H_2O$ | 0.03 |
| Snowflake No. 301 Ground Calcite (-325 mesh) | 9.73 |
| | 100.0 |

Two compositions were made up as follows (in % by weight):

| | A | B |
|---|---|---|
| Water | 30.8390 | 35.33% |
| Sorbitol | 4.00 | — |
| Ternary Acetate eutectic[1] | 3.00 | 3.60 |
| Potassium bicarbonate | 0.50 | — |
| Carrier mixture | 61.67 | 61.67 |
| | 100.00 | 100.00 |

[1]The (known) ternary acetate eutectic mixture had the following composition and has a eutectic melting point in the neighborhood of 315° F.

| | |
|---|---|
| Sodium acetate, anhydrous | 23.3% by weight |
| Potassium acetate, anhydrous | 42.3 |
| Lithium acetate, dihydrate | 34.4 |
| | 100.0 |

Four inch by eight inch patches of both compositions were brushed uniformly onto each of two of the above described test panels. One panel was heated for 30 minutes in an oven at 300° F. and the other for 30 minutes in a second oven set at 320° F. At the end of the heating period, the panels were cooled and washed with cold water and a sponge. Cleaning results were as follows, the figures indicating the percentage of each test area cleaned down to the underlying porcelain enamel.

| Composition | 30 min./300° F. | 30 min./320° F. |
|---|---|---|
| A | 100% | 100% |
| B | 0 | 2% |

These tests clearly show that composition A of the invention cleans well at temperatures convenient for household ovens and indicate that the addition of sorbitol and potassium bicarbonate to 3% of the ternary acetate eutectic has greatly enhanced the cleaning efficacy at temperatures of 300°-320° F.

EXAMPLE 2

Two additional compositions were made up, as follows, for comparison with composition A of Example 1 at still lower temperatures.

| | C | D |
|---|---|---|
| Water | 31.33% | 33.83% |
| Sorbitol | 4.00 | 4.00 |
| Ternary acetate eutectic | 3.00 | — |
| Potassium bicarbonate | — | 0.50 |
| Carrier mixture | 61.67 | 61.67 |
| | 100.00 | 100.00 |

One set of the three compositions A, C, and D was brushed uniformly onto each of three different prepared test panels which were then heated separately for the times and the temperatures given in the table below. Again, the results are in terms of percentages of the soiled area cleaned down to the underlying porcelain enamel as in Example 1.

| Composition | 30 min./285° F. | 60 min./285° F. | 60 min./255° F. |
|---|---|---|---|
| A | 2% | 90% | 40% |
| C | O | 85 | 8 |
| D | 2 | 98 | 50 |

It will be seen that none of the three compositions cleaned acceptably at the low temperature of 285° F. until the heating period was extended from 30 minutes to 60 minutes. At 255° F., it is seen that compositions A and D containing 0.50% potassium bicarbonate retain a measure of effectiveness whereas composition C containing no potassium bicarbonate does not.

EXAMPLE 3

Another composition (E) was prepared for comparison with compositions A and B of Example 1 at the comparatively high oven temperature of 475° F. Such a temperature is typical of those frequently found on the overheated spots of ovens when set at ordinary baking temperatures in the range of 325° to 350° F.

| | E |
|---|---|
| Water | 28.33% |
| Ternary acetate eutectic[1] | 10.00 |
| Carrier mixture | 61.67 |
| | 100.00 |

Each of the three compositions A, B and E was packed into commercial aerosol cans containing 80% by weight of the aqueous composition and 20% by weight of a known propellant mixture. Four inch by ten inch test strips of each of the three compositions were sprayed onto a prepared test panel, leaving narrow strips of uncoated soil between the test strips. The panel was then placed in an oven set at 475° F. and heated for 30 minutes. On cooling and washing as before, the percentages of soil area removed were as follows:

| Composition | |
|---|---|
| A (of Example 1) | 100% |
| B (of Example 1) | Partial[2] |
| E (above) | 100% |

[1]See note (1) under Example 1.
[2] With composition B, all of the originally thinner soil areas were completely cleaned, but many streaks and patches of soil which had originally been slightly thicker were only partially cleaned, giving the test area an unsatisfactory appearance.

It is seen that composition A, which contains sorbitol and potassium bicarbonate in addition to 3% of the ternary acetate eutectic cleaned as well at 475° F. as did composition E, which contained 10% of the eutectic.

Various modifications of the compositions and method of the invention may be made without departing from the spirit or scope thereof and it is to be understood that the invention is intended to be limited only as defined in the appended claims.

We claim:

1. A weakly alkaline composition for removing soil containing free or combined organic acids comprising (A) at least one polyhydric alcohol or a lower aliphatic ether or ester thereof having at least 2 free hydroxy groups, (B) 1.0 to 500% by weight of at least one alkali metal bicarbonate based on the weight of the polyhydric alcohol and (C) 5.0 to 1000% by weight of at least one alkali metal salt of a weak organic acid based on the weight of the polyhydric alcohol.

2. The composition of claim 1 wherein the alkali metal salt of the weak organic acid is a mixture of at least 2 alkali metal salts of acetic acid.

3. The composition of claim 2 wherein the alkali metal salt(s) is an eutectic mixture of the sodium, potassium and lithium acetates.

4. The composition of claim 1 wherein the polyhydric alcohol compound having at least 2 hydroxy groups is selected from the group consisting of ethylene glycol, diethylene glycol, triethylene glycol, glycerol, diglycerol, triglycerol, pentaerythritol, sorbitol, mannitol, inositol, trimethylol propane, trimethylol ethane, and partial esters of polyols having at least 2 free hydroxy groups and aliphatic carboxylic acids of 1 to 7 carbon atoms.

5. The composition of claim 1 wherein the polyhydric alcohol compound has a ratio of carbon atoms to hydroxyl groups of not more than 4.

6. The composition of claim 1 wherein the polyhydric alcohol is selected from the group consisting of mannitol and sorbitol.

7. The composition of claim 1 wherein the composition is anhydrous.

8. The composition of claim 1 in the form of an aqueous concentrate wherein the polyhydric alcohol has a boiling point above 350° F., is water-soluble and melts below 500° F. and is present in 1 to 90% by weight of the aqueous composition.

9. A composition of claim 8 comprising in its aqueous concentrate portion 3 to 14% by weight of a cleaning composition comprising 2 to 5 parts by weight of sorbitol, 0.1 to 4 parts by weight of an alkali metal bicarbonate and 1 to 5 parts by weight of an eutectic mixture of sodium acetate, potassium acetate and lithium acetate, an aqueous carrier, a thickening agent, a finely divided material to aid even spreading and a wetting agent with the balance being an aerosol propellant under pressure.

10. The composition of claim 1 wherein the composition also contains at least one member of the group consisting of a surface active agent and an inert, fine granular material.

* * * * *